US010428761B2

(12) United States Patent
Scherbaum et al.

(10) Patent No.: US 10,428,761 B2
(45) Date of Patent: Oct. 1, 2019

(54) GALLERYLESS PISTON WITH IMPROVED POCKET COOLING

(71) Applicant: FEDERAL-MOGUL LLC, Southfield, MI (US)

(72) Inventors: Thomas Scherbaum, Forchheim (DE); Sven Ungermann, Nürnberg (DE); Harald Mergler, Nürnberg (DE); Josef Harrer, Hilpoltstein (DE); Michael Seiffert, Nürnberg (DE); Georg Hopp, Rednithembach (DE); Arnd Baberg, Fürth (DE); Hanno Necker, Nürnberg (DE); Michael Weinenger, Southfield, MI (US); Jeffrey L. Riffe, Troy, MI (US)

(73) Assignee: Tenneco Inc., Lake Forest, IL (US)

( * ) Notice: Subject to any disclaimer, the term of this patent is extended or adjusted under 35 U.S.C. 154(b) by 89 days.

(21) Appl. No.: 15/437,631

(22) Filed: Feb. 21, 2017

(65) Prior Publication Data

US 2017/0241374 A1 Aug. 24, 2017

Related U.S. Application Data

(60) Provisional application No. 62/298,952, filed on Feb. 23, 2016.

(30) Foreign Application Priority Data

Mar. 23, 2016 (DE) ..... 10 2016 204 830

(51) Int. Cl.

| | |
|---|---|
| ***F02F 3/00*** | (2006.01) |
| ***F02F 3/22*** | (2006.01) |
| ***F02F 3/20*** | (2006.01) |

(52) U.S. Cl.
CPC ..... *F02F 3/22* (2013.01); *F02F 3/0076* (2013.01); *F02F 3/0084* (2013.01); *F02F 3/20* (2013.01); *F02F 2200/06* (2013.01)

(58) Field of Classification Search
CPC ..... F02F 3/22; F02F 3/0076; F02F 3/0084; F02F 3/20; F02F 2200/06
(Continued)

(56) References Cited

U.S. PATENT DOCUMENTS

| | | | |
|---|---|---|---|
| 1,327,147 | A | 1/1920 | Church |
| 2,046,196 | A | 6/1936 | Truxell, Jr. |

(Continued)

FOREIGN PATENT DOCUMENTS

| | | | |
|---|---|---|---|
| DE | 3814500 | A1 | 11/1989 |
| DE | 10106435 | A1 | 8/2002 |

(Continued)

OTHER PUBLICATIONS

International Search Report, dated May 10, 2017 (PCT/US2017/018777).

*Primary Examiner* — Joseph J Dallo
*Assistant Examiner* — Yi-Kai Wang
(74) *Attorney, Agent, or Firm* — Robert L. Stearns; Dickinson Wright, PLLC

(57) ABSTRACT

A galleryless piston having a reduced temperature during operation in an engine is provided. The piston includes an upper wall with an exposed undercrown surface. A ring belt and pin bosses depend from the upper wall, and a pair of skirt panels depend from the ring belt and are coupled to the pin bosses by struts. The piston includes an inner undercrown region and outer pockets extending along the undercrown surface. The inner undercrown region is surrounded by the skirt panels, the struts, and the pin bosses. Each outer pocket is surrounded by one of the pin bosses, a portion of
(Continued)

the ring belt, and the struts adjacent the one pin boss. A plurality of holes extend through the pin bosses and/or the struts from the inner undercrown region to one of the outer pockets to convey cooling oil from the inner undercrown region to the outer pockets.

20 Claims, 9 Drawing Sheets

(58) Field of Classification Search
USPC ..... 123/41.39
See application file for complete search history.

(56) References Cited

U.S. PATENT DOCUMENTS

| | | | | |
|---|---|---|---|---|
| 3,161,188 | A | 12/1964 | Liebel et al. | |
| 5,839,407 | A | 11/1998 | Suzuki et al. | |
| 5,860,395 | A | 1/1999 | Klotz et al. | |
| 6,772,846 | B1 | 8/2004 | Scharp | |
| 6,938,603 | B2 | 9/2005 | Scharp | |
| 7,997,249 | B2 | 8/2011 | Matsui et al. | |
| 8,453,559 | B2 | 6/2013 | Ohmori et al. | |
| 8,601,994 | B2 | 12/2013 | Mukouhara et al. | |
| 8,662,049 | B2 | 3/2014 | Nodl | |
| 2002/0189442 | A1* | 12/2002 | Zhu | F02F 3/003 92/208 |
| 2009/0301426 | A1 | 12/2009 | Ko | |
| 2010/0229820 | A1* | 9/2010 | Iwata | F02F 3/00 123/193.6 |
| 2012/0260868 | A1* | 10/2012 | Scharp | F02F 3/22 123/41.39 |
| 2014/0076264 | A1* | 3/2014 | Matsuo | F02F 3/0015 123/193.6 |
| 2015/0000618 | A1* | 1/2015 | Han | F01P 3/10 123/41.35 |
| 2015/0122212 | A1 | 5/2015 | Riffe et al. | |
| 2016/0123274 | A1 | 5/2016 | Miller et al. | |
| 2016/0169153 | A1* | 6/2016 | Burger | F02F 3/00 123/193.6 |

FOREIGN PATENT DOCUMENTS

| | | | | |
|---|---|---|---|---|
| DE | 102008064470 | A1 | 12/2009 | |
| EP | 1231374 | A2 * | 8/2002 | F02F 3/22 |
| EP | 1231374 | A2 * | 8/2002 | F02F 3/22 |
| EP | 1231374 | B1 | 3/2008 | |
| JP | H0327856 | U | 3/1991 | |
| JP | 2005090448 | A | 4/2005 | |
| JP | 2006214298 | A | 8/2006 | |
| WO | 2016070031 | A1 | 5/2016 | |

* cited by examiner

GALLERYLESS PISTON WITH IMPROVED POCKET COOLING

CROSS-REFERENCE TO RELATED APPLICATIONS

This U.S. utility patent application claims priority to U.S. provisional patent application No. 62/298,952, filed Feb. 23, 2016, and German patent application 10 2016 204 830.9, filed Mar. 23, 2016, the contents of which are incorporated herein by reference in their entirety.

BACKGROUND OF THE INVENTION

1. Technical Field

This invention relates generally to pistons for internal combustion engines, and methods of manufacturing the pistons.

2. Related Art

Engine manufacturers are encountering increasing demands to improve engine efficiencies and performance, including, but not limited to, improving fuel economy, reducing oil consumption, improving fuel systems, increasing compression loads and operating temperatures within the cylinder bores, reducing heat loss through the piston, improving lubrication of component parts, decreasing engine weight and making engines more compact, while at the same time decreasing the costs associated with manufacture.

While desirable to increase the compression load and operation temperature within the combustion chamber, it remains necessary to maintain the temperature of the piston within workable limits. To maintain the piston at a suitable temperature and achieve a sufficient lifespan, the piston can be designed with a variety of features for cooling, for example cooling channels and/or coolant nozzles for spraying the piston from the side of the crank shaft.

Also, achieving an increase in the compression load and operation temperature comes with a tradeoff in that these desirable "increases" limit the degree to which the piston compression height, and thus, overall piston size and mass can be decreased. This is particularly troublesome with typical piston constructions having a closed or partially closed cooling gallery to reduce the operating temperature of the piston. The cost to manufacture pistons having upper and lower parts joined together along a bond joint to form the closed or partially closed cooling gallery is generally increased due to the joining process used to bond the upper and lower parts together. Further, the degree to which the engine weight can be reduced is impacted by the need to make the aforementioned "cooling gallery-containing" pistons from steel so they can withstand the increase in mechanical and thermal loads imposed on the piston.

Oftentimes, it is also desirable to keep the piston as lightweight as possible. Recently, single piece steel pistons without a cooling gallery have been developed and can be referred to as "galleryless" pistons. Such pistons provide for reduced weight, reduced manufacturing costs, and reduced compression height. The galleryless pistons are either spray cooled by a cooling oil nozzle, lightly sprayed for lubrication only, or are not sprayed with any oil. Due to the absence of the cooling gallery, such pistons typically experience higher temperatures than pistons with a conventional cooling gallery. High temperatures can cause oxidation or overheating of an upper combustion surface of the steel piston, which can then cause successive piston cracking and engine failures. High temperatures can also cause oil degradation along an undercrown area of the piston, for example underneath a combustion bowl where the cooling or lubrication oil is sprayed. Another potential problem arising due to high temperatures is that the cooling oil can create a thick layer of carbon in the area where the cooling or lubrication oil is in contact with the piston undercrown. This carbon layer can cause overheating of the piston with potential cracking and engine failure.

SUMMARY OF THE INVENTION

One aspect of the invention provides a galleryless piston having a reduced temperature during operation in an internal combustion engine and thus contributing to improved thermal efficiency, fuel consumption, and performance of the engine. In addition to providing sufficient cooling, the piston is also weight-optimized. The piston is free of a closed cooling gallery along an undercrown surface and thus has a reduced weight and related costs, relative to pistons including a closed cooling gallery.

The piston comprises an upper wall including the undercrown surface exposed from an underside of the piston. A ring belt depends from the upper wall and extends circumferentially around a center axis of the piston. A pair of pin bosses depend from the upper wall, a pair of skirt panels depend from the ring belt, and the skirt panels are coupled to the pin bosses by struts. The piston includes an inner undercrown region and outer pockets extending along the undercrown surface. The inner undercrown region is surrounded by the skirt panels, the struts, and the pin bosses. Each outer pocket is surrounded by one of the pin bosses, a portion of the ring belt, and the struts coupling the one pin boss to the skirt panels. At least one hole extends through at least one of the pin bosses and/or at least one of the struts from the inner undercrown region to one of the outer pockets. The hole allows oil to pass from the inner undercrown region to at least one of the outer pockets, which improves cooling of the at least one outer pocket and thus reduces the overall temperature of the piston.

Another aspect of the invention provides a method of manufacturing a weight-optimized, galleryless piston having a reduced temperature during operation in an internal combustion engine and thus contributing to improved thermal efficiency, fuel consumption, and performance of the engine. The method comprises the step of providing a body including an upper wall, the upper wall including an undercrown surface exposed from an underside of the piston, a ring belt depending from the upper wall and extending circumferentially around a center axis of the piston, a pair of pin bosses depending from the upper wall, a pair of skirt panels depending from the ring belt and coupled to the pin bosses by struts, an inner undercrown region extending along the undercrown surface and surrounded by the skirt panels and the struts and the pin bosses, a pair of outer pockets extending along the undercrown surface, each outer pocket being surrounded by one of the pin bosses, a portion of the ring belt, and the struts coupling the one pin boss to the skirt panels. The method further includes forming at least one hole through at least one of the pin bosses and/or at least one of the struts from the inner undercrown region to one of the outer pockets.

BRIEF DESCRIPTION OF THE DRAWINGS

These and other aspects, features and advantages of the invention will become more readily appreciated when considered in connection with the following detailed description and accompanying drawings, in which.

DETAILED DESCRIPTION OF EXEMPLARY EMBODIMENTS

Figure 1:
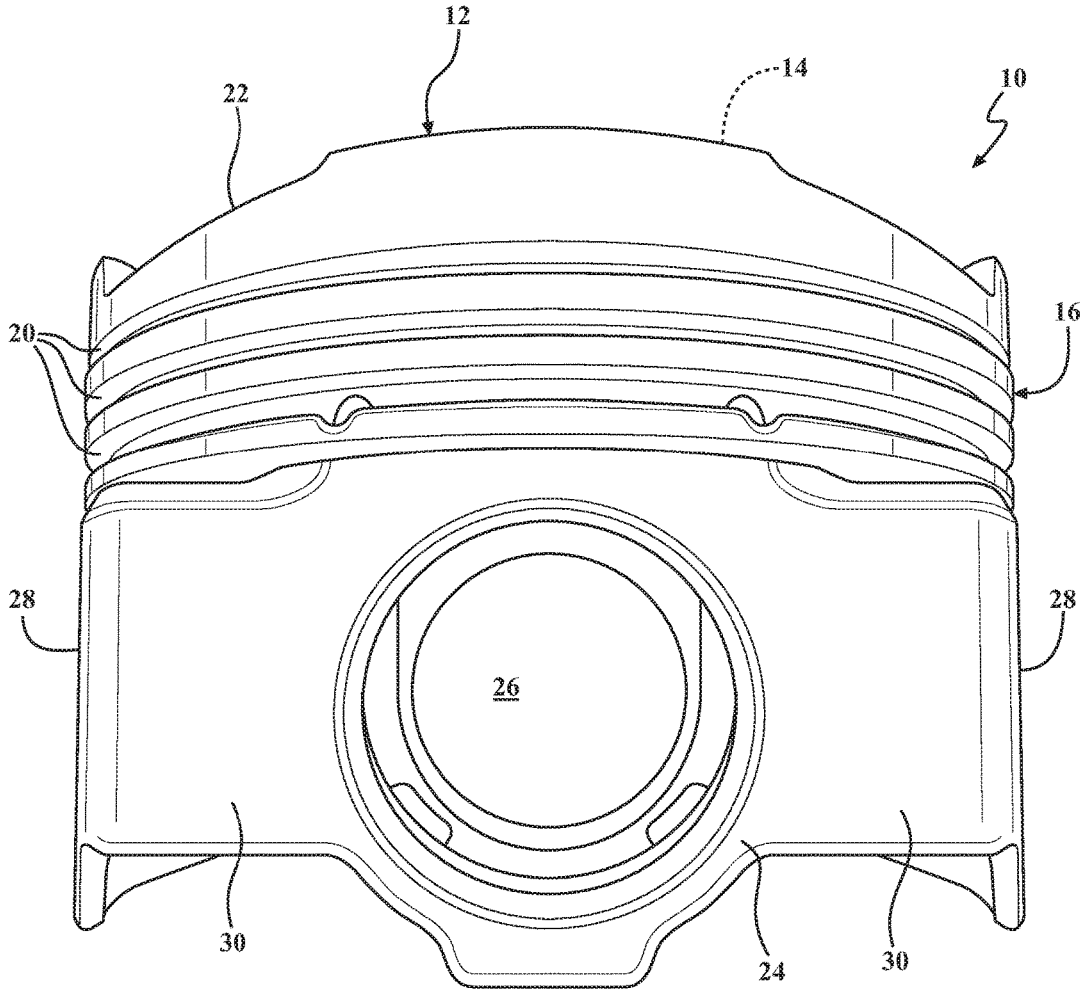
FIG. 1 is a front side view of a galleryless piston constructed in accordance with an example embodiment of the invention.

FIGS. 1-10 illustrate views of a piston 10 constructed in accordance with example embodiments of the invention for reciprocating movement in a cylinder bore or chamber (not shown) of an internal combustion engine, such as a modern, compact, high performance vehicle engine, for example. The piston 10 can also be used in diesel, and gasoline engines. The piston 10 is designed to operate at a reduced temperature and thus contribute to improved thermal efficiency, fuel consumption, and performance of the engine.

The piston 10 has a monolithic body formed from a single piece of metal material, such as steel or an aluminum-based material. The monolithic body can be formed by machining, forging, or casting, with possible finish machining performed thereafter, if desired, to complete construction. Accordingly, the piston 10 does not have a plurality of parts joined together, such as upper and lower parts joined to one another, which is commonplace with pistons having enclosed or partially enclosed cooling galleries bounded or partially bounded by a cooling gallery floor. To the contrary, the piston 10 is "galleryless" in that it does not have a cooling gallery floor or other features bounding or partially bounding a cooling gallery.

The body portion, being made of steel, aluminum, or another metal, is strong and durable to meet the high performance demands, i.e. increased temperature and compression loads, of modern day high performance internal combustion engines. The steel material used to construct the body can be an alloy such as the SAE 4140 grade or different, depending on the requirements of the piston 10 in the particular engine application. Due to the piston 10 being galleryless, the weight and compression height of the piston 10 is minimized, thereby allowing an engine in which the piston 10 is deployed to achieve a reduced weight and to be made more compact. Further yet, even though the piston 10 is galleryless, the piston 10 can be sufficiently cooled during use to withstand the most severe operating temperatures.

The body portion of the piston 10 has an upper head or top section providing an upper wall 12. The upper wall 12 includes an upper combustion surface 14 that is directly exposed to combustion gasses within the cylinder bore of the internal combustion engine. In the example embodiment, the upper combustion surface 14 forms a combustion bowl, or a non-planar, concave, or undulating surface around a center axis A. A ring belt 16 providing a top land 18 followed by a plurality of ring grooves 20 depends from the upper wall 12 and extends circumferentially around the center axis A and along an outer diameter of the piston 10. In the example embodiment of FIG. 1, at least one valve pocket 22 having a curved profile is formed in the upper wall 12 of the piston 10.

As shown in the Figures, the piston 10 further includes a pair of pin bosses 24 depending generally from the upper wall 12 inwardly of the ring belt 16 and providing a pair of laterally spaced pin bores 26. The pin bores 26 surround a pin bore axis B. The piston 10 also includes a pair of skirt panels 28 depending from the ring belt 16 and located diametrically opposite one another. The skirt panels 28 are coupled to the pin bosses 24 by struts 30.

The piston 10 also includes an undercrown surface 32 formed on an underside of the upper wall 12, directly opposite the upper combustion surface 14 and radially inwardly of the ring belt 16. The undercrown surface 32 is preferably located at a minimum distance from the combustion bowl and is substantially the surface on the direct opposite side from the combustion bowl. The undercrown surface 32 is defined here to be the surface that is visible, excluding any pin bores 26, when observing the piston 10 straight on from the bottom. The undercrown surface 32 is generally form fitting to the combustion bowl of the upper combustion surface 14. The undercrown surface 32 is also openly exposed, as viewed from an underside of the piston 10, and it is not bounded by an enclosed or partially enclosed cooling gallery, or any other features tending to retain oil or a cooling fluid near the undercrown surface 32.

The undercrown surface 32 of the piston 10 has greater a total surface area (3-dimensional area following the contour of the surface) and a greater projected surface area (2-dimensional area, planar, as seen in plan view) than comparative pistons having a closed or partially closed cooling gallery. This open region along the underside of the piston 10 provides direct access to oil splashing or being sprayed from within the crankcase directly onto the undercrown surface 32, thereby allowing the entire undercrown surface 32 to be splashed directly by oil from within the crankcase, while also allowing the oil to freely splash about the wrist pin (not shown), and further, significantly reduce the weight of the piston 10. Accordingly, although not having a typical closed or partially closed cooling gallery, the generally open configuration of the galleryless piston 10 allows optimal cooling of the undercrown surface 32 and lubrication to the wrist pin joint within the pin bores 26, while at the same time reducing oil residence time on the surfaces near the combustion bowl, which is the time in which a volume of oil remains on the surface. The reduced residence time can reduce unwanted build-up of coked oil, such as can occur in pistons having a closed or substantially closed cooling gallery. As such, the piston 10 remains "clean" over extended use, thereby allowing it to remain substantially free of build-up.

Figure 2:
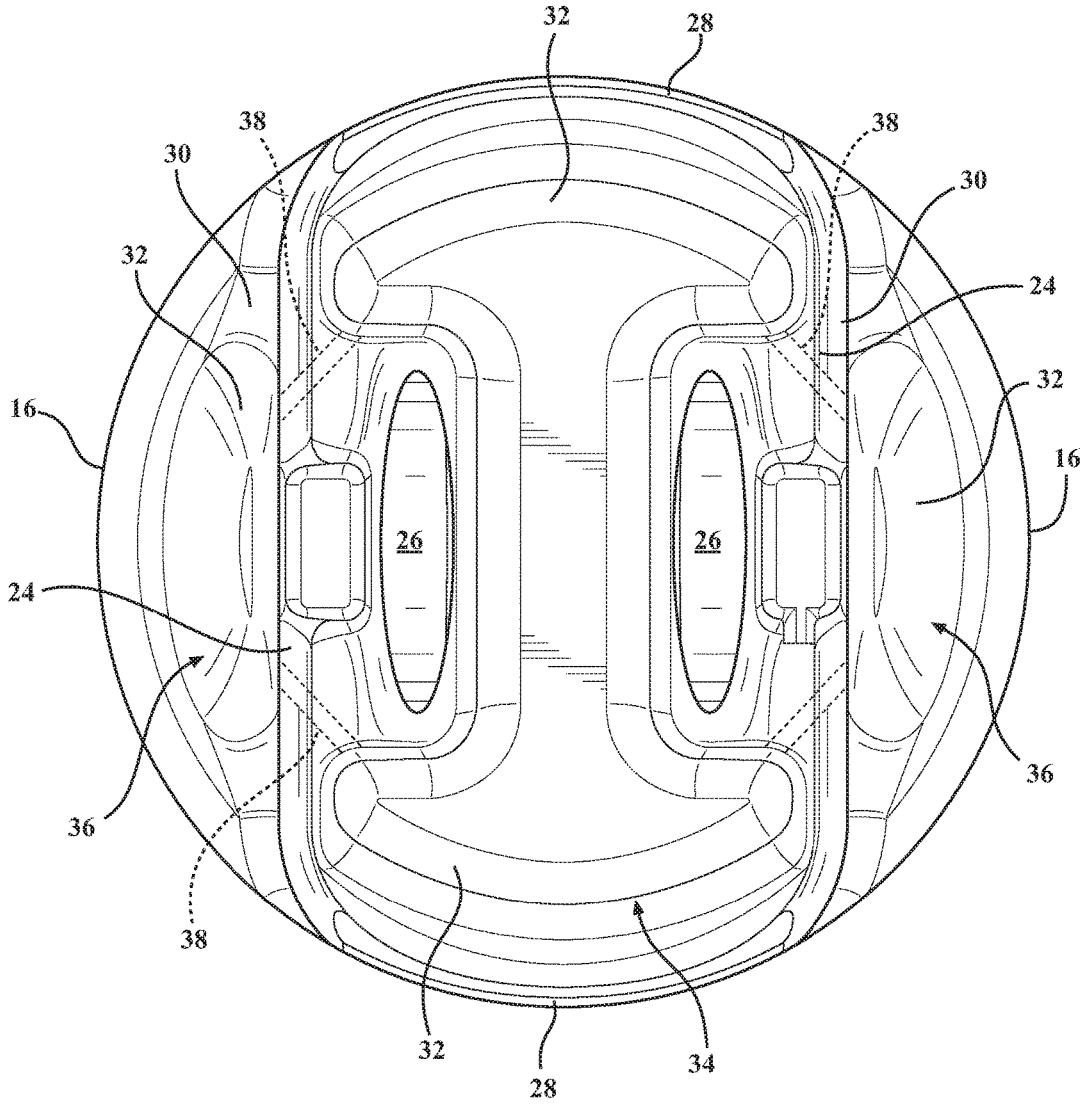
FIG. 2 is a bottom view of the galleryless piston of FIG. 1 showing an undercrown surface of an inner undercrown region and outer pockets.
Figure 10:
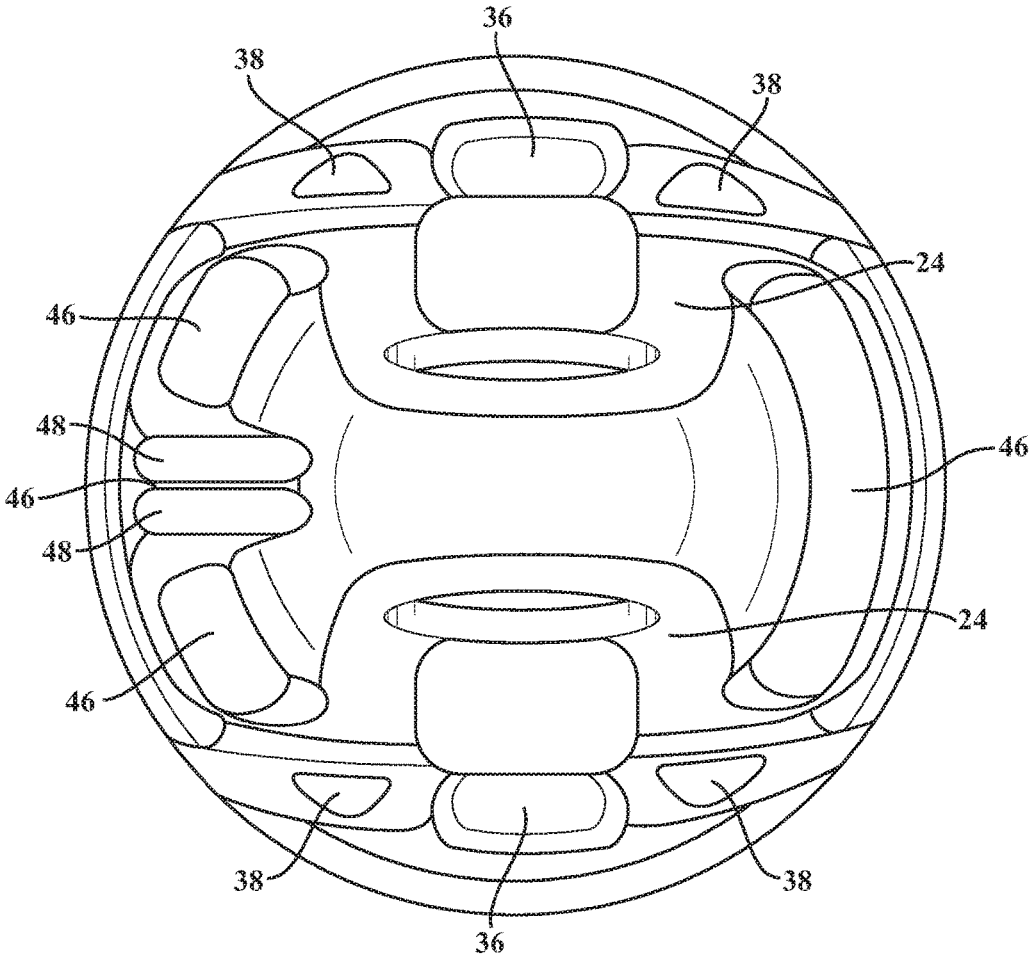
FIG. 10 is a bottom view of the piston of FIG. 8 showing a deflector.

The undercrown surface 32 of the piston 10 of the example embodiments is provided by several regions of the piston 10, including an inner undercrown region 34 and outer pockets 36, which are best shown in FIGS. 2 and 10.

A first portion of the undercrown surface 32 located at the center axis A is provided by the inner undercrown region 34. The inner undercrown region 34 is surrounded by the pin bosses 24, skirt panels 28, and struts 30. The 2-dimensional and 3-dimensional surface area of the undercrown surface 32 provided by the inner undercrown region 34 is typically maximized so that cooling caused by oil splashing or being sprayed upwardly from the crankcase against the exposed surface can be enhanced, thereby lending to exceptional cooling of the piston 10. In the example embodiments, the undercrown surface 32 located in the inner undercrown 34 region is concave, when viewed from the bottom, such that oil can be channeled during reciprocation of the piston 10 from one side of the piston 10 to the opposite side of the piston 10, thereby acting to further enhance cooling of the piston 10.

A second region of the undercrown surface 32 is provided by the outer pockets 36 which are located outwardly of the pin bosses 24. Each outer pocket 36 is surrounded by one of the pin bosses 24, a portion of the ring belt 16, and the struts 30 coupling the one pin boss 24 to the skirt panels 28. The outer pockets 36 include a hollow extending from the bottom, the side of the crankshaft, and heads in the direction of the undercrown surface 32 and to an inner surface of the ring belt 16. In the example embodiment of FIGS. 8-10, the outer pockets 36, in the direction of the center axis A, spread over at least 50% of the height of the ring belt 16. The outer pockets 36 conveniently save weight of the piston 10.

To allow cooling oil to pass from the inner undercrown region 34, where the oil jet typically sprays the cooling oil, to the outer pockets 36, at least one hole 38, and preferably a plurality of holes 38 extend through the pin bosses 24 and/or the struts 30 from the inner undercrown region 34 to the outer pockets 36. FIGS. 3-6, 9, and 10 show examples of the holes 38 extending through the pin bosses 24 and/or struts 30 to the outer pockets 36. The supply of cooling oil provided to the outer pockets 36 via the holes 38 improves cooling of the outer pocket 36 and thus reduces the overall temperature of the piston 10. Due to the presence of the holes 38, a typical cooling channel is not required. Typically, the cooling oil is injected at the bottom of the piston 10, in an area adjacent to a wrist pin, and is diverted and passes through the holes 38 to the outer pockets 36 to achieve the desired cooling over a large area.

Figure 3:
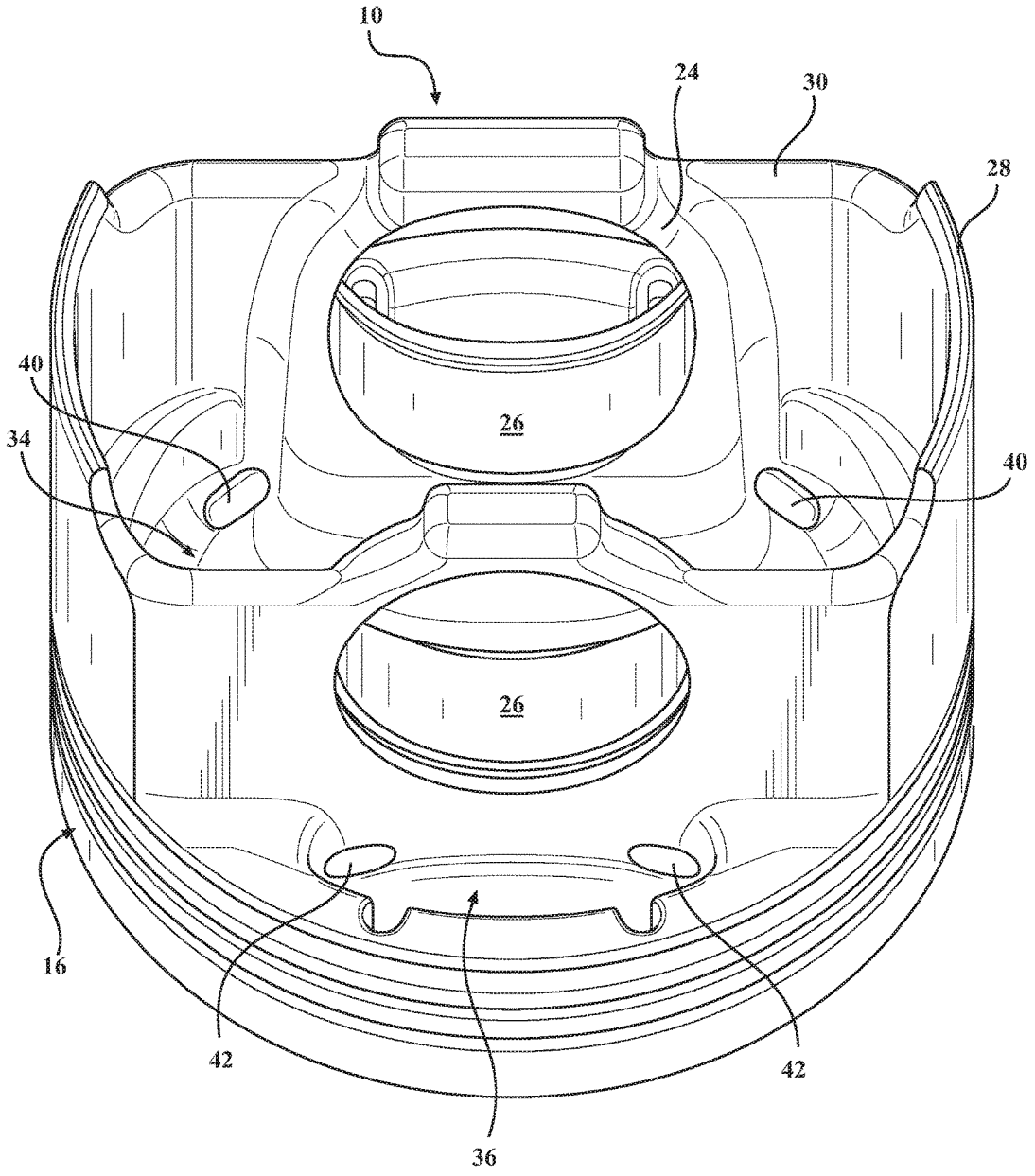
FIG. 3 is a perspective view of the piston of FIG. 1 showing holes extending through a pin boss from the inner undercrown region to the outer pockets.
Figure 4:
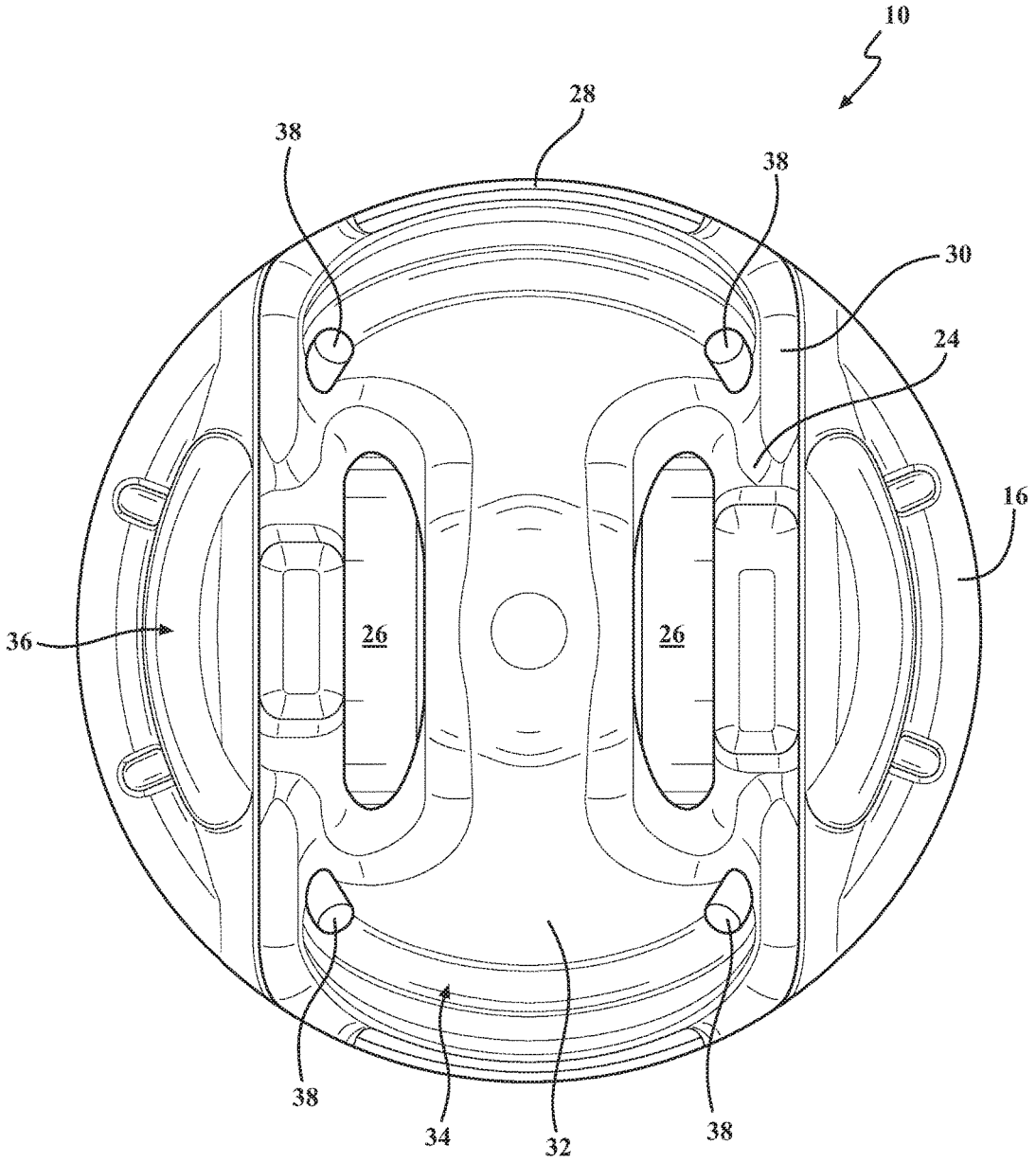
FIG. 4 is a bottom view of the piston of FIG. 1.
Figure 5:
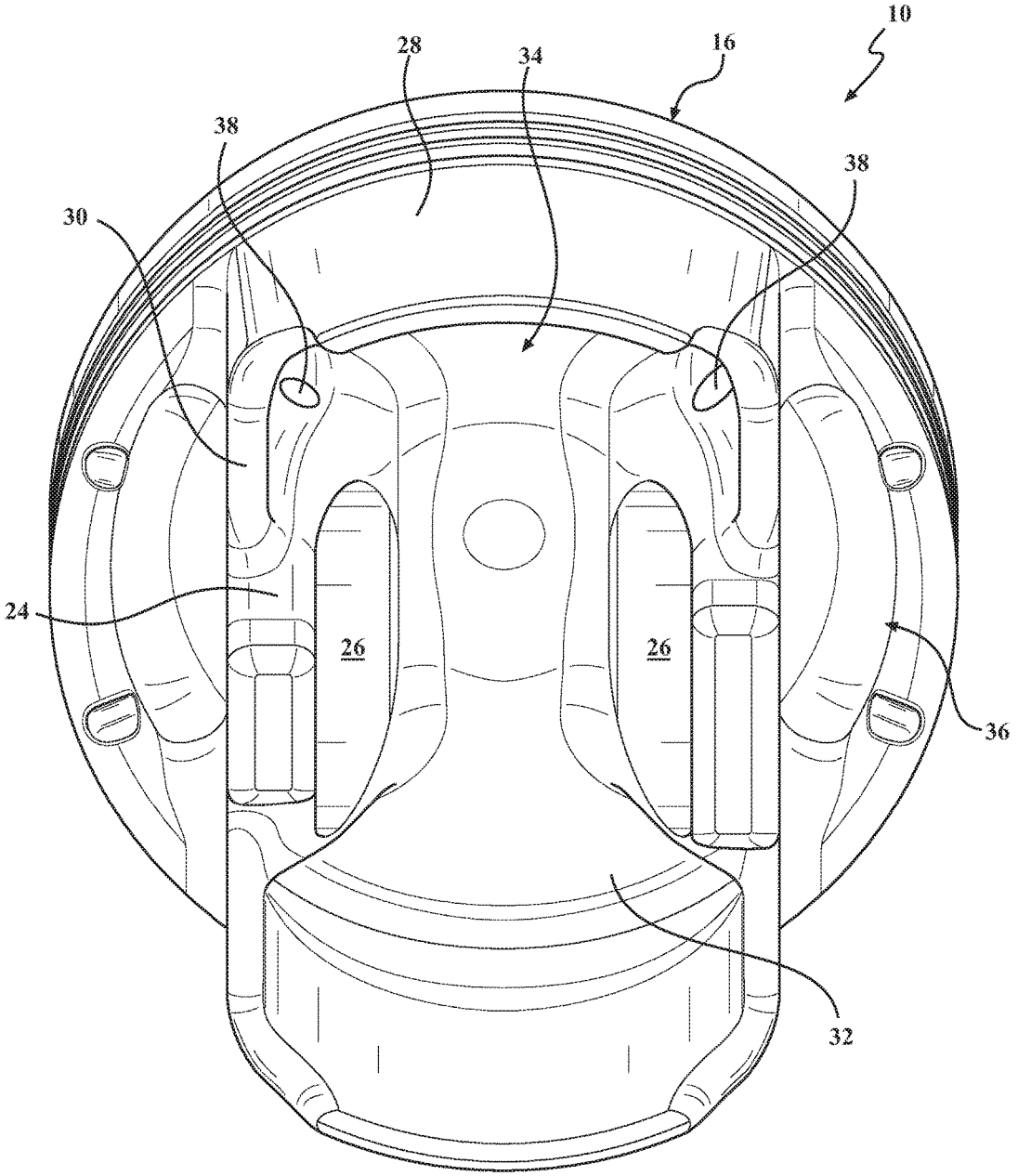
FIG. 5 is another perspective view of the piston of FIG. 1.
Figure 6:
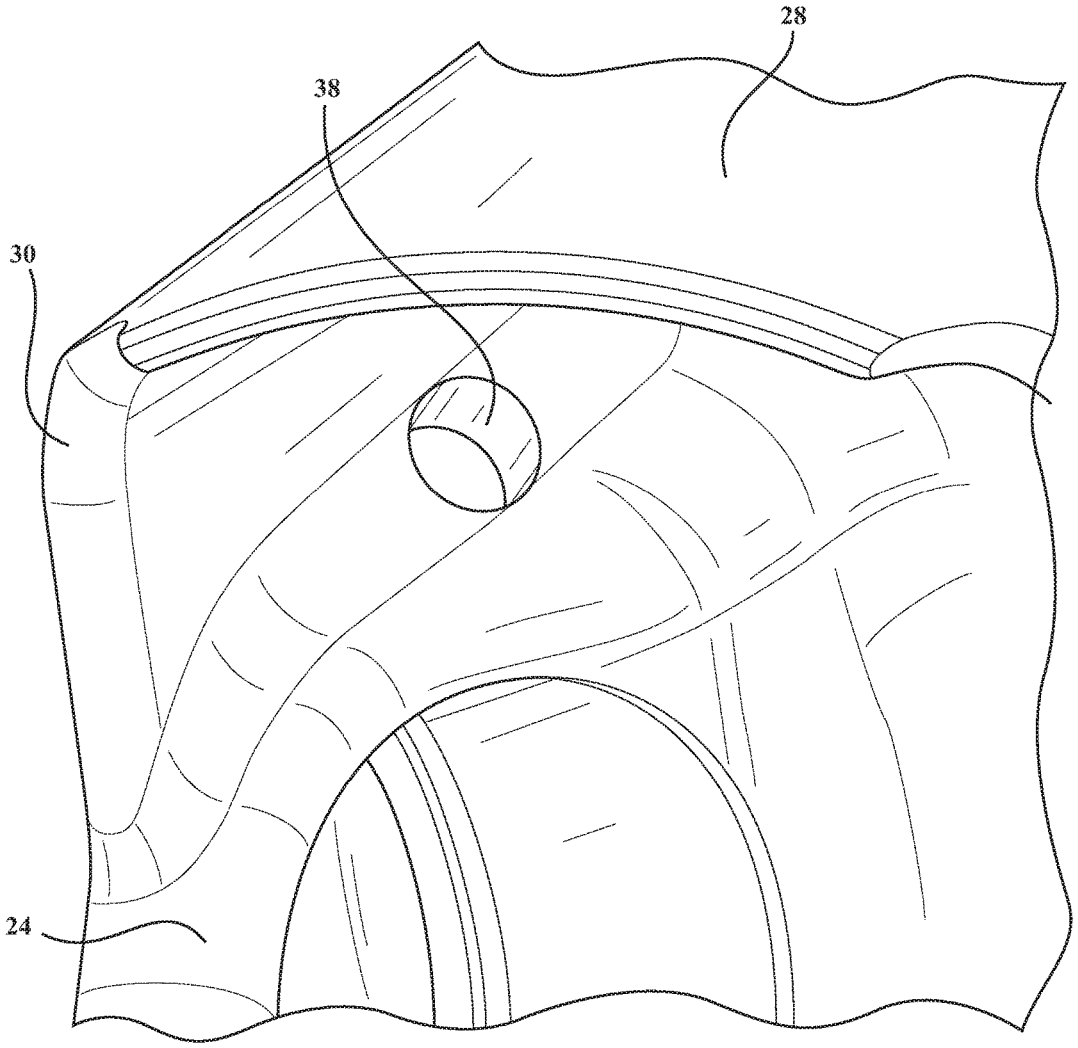
FIG. 6 is an enlarged view of one of the holes extending through the pin boss of a piston according to another example embodiment.

The holes 38 can be placed in various different locations along the undercrown surface 32, pin bosses 24, and/or struts 30 to provide a connection from the inner undercrown region 34 to the outer pockets 36. In the example embodiments, the holes 38 are located near the top of the piston 10 or higher, for example adjacent the undercrown surface 32. In the embodiments shown in the FIGS. 1-7, two holes 38 are located between the inner undercrown region 34 and a first one of the outer pockets 36, and two holes 38 are located between the inner undercrown region 34 and a second one of the outer pockets 36. As best shown in FIG. 3, each hole 38 extends from a first opening 40 to a second opening 42. The first opening 40 is located in the inner undercrown region 34 adjacent one of the struts 30 between the skirt panel 28 and pin boss 24. The second opening 42 is located in the outer pocket 36 at a side of the pin boss 24, adjacent the strut 30. The holes 38 can be positioned at an angle relative to the center axis A of the piston 10 and relative to a pin bore axis B so that at certain crank angles, cooling oil spraying from the oil jet is directed into the first openings 40 and through the holes 38 to the outer pockets 36. The angle of each the hole 38 depends on the specific engine design, location of the oil jet, and crank angles. According to one embodiment, the holes 38 are angled in an upward direction from the inner undercrown region 34 to the outer pockets 36.

Figure 8:
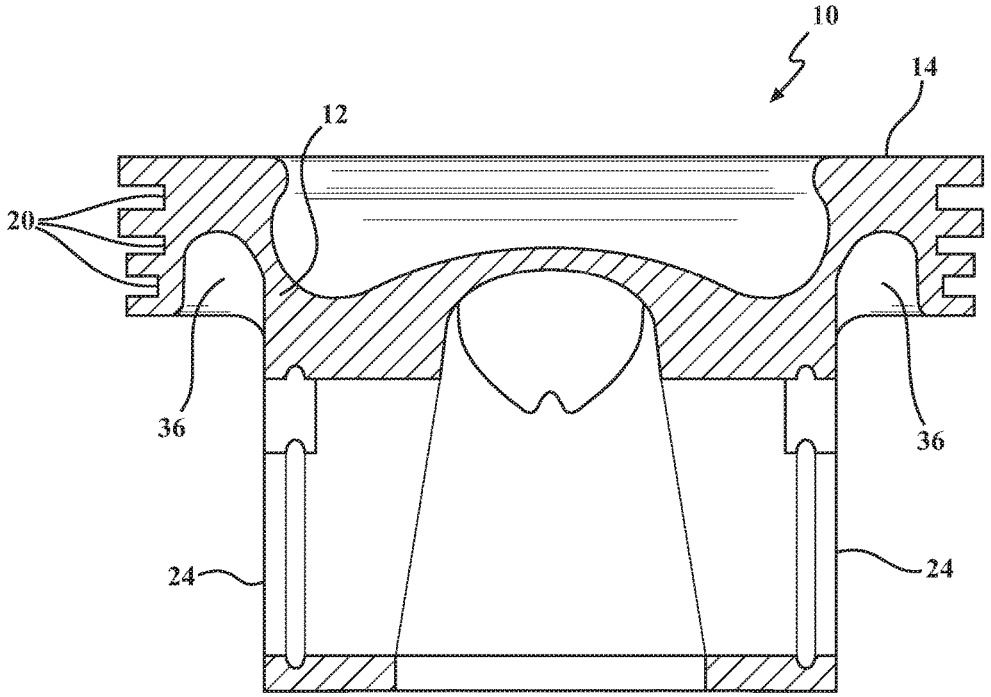
FIG. 8 is a cross-sectional view through the pinbore axis of a galleryless piston constructed in accordance with another example embodiment of the invention.
Figure 9:
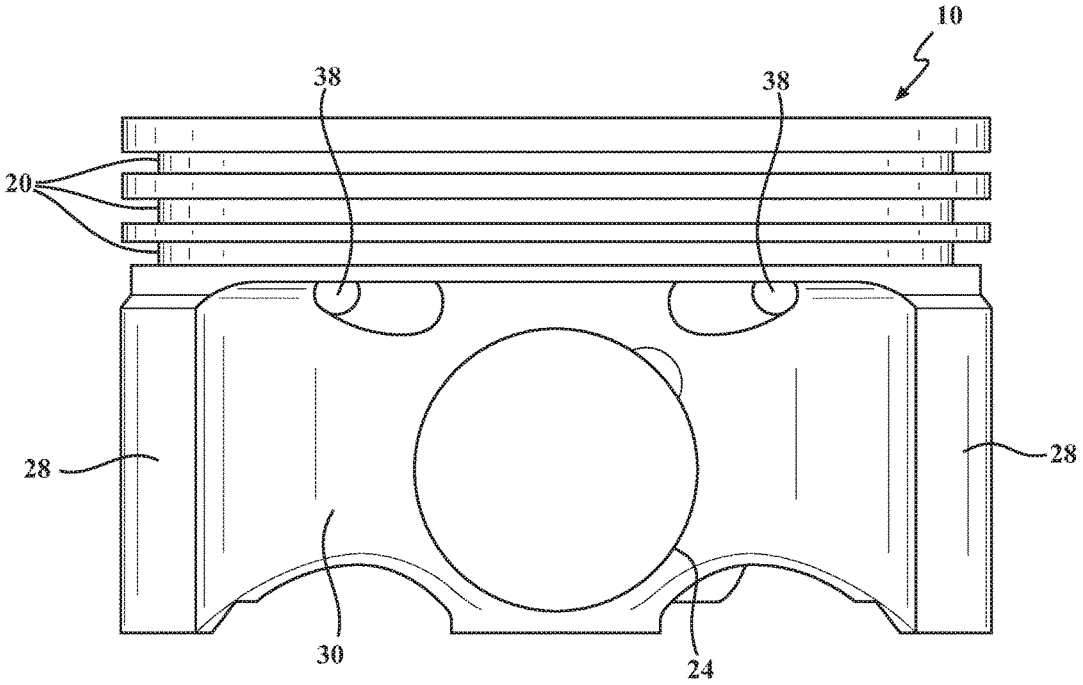
FIG. 9 is a front view of the galleryless piston of FIG. 8 in the direction of the pin bore axis.

In the example embodiment of FIGS. 8-10, two holes 38 are located in each pin boss 24 on opposite sides of the pin bore 26 and in an upper area bordering the ring belt 16 to allow the cooling oil sprayed from the underside of the piston 10 to access the outer pockets 36. Alternatively, one hole 38 could be located in each strut 30 on opposite sides of the adjacent pin boss 24. The holes 38 extend in the direction of the outer pockets 36 in order to enable a good flow of the cooling oil. The piston 10 of this embodiment includes four holes 38 in total which overall extend in a substantially tangential manner. In FIG. 10, the two left holes 38 are essentially in the extension of the respective outer pocket 36 which extends circumferentially toward the skirt panels 28.

Figure 7:
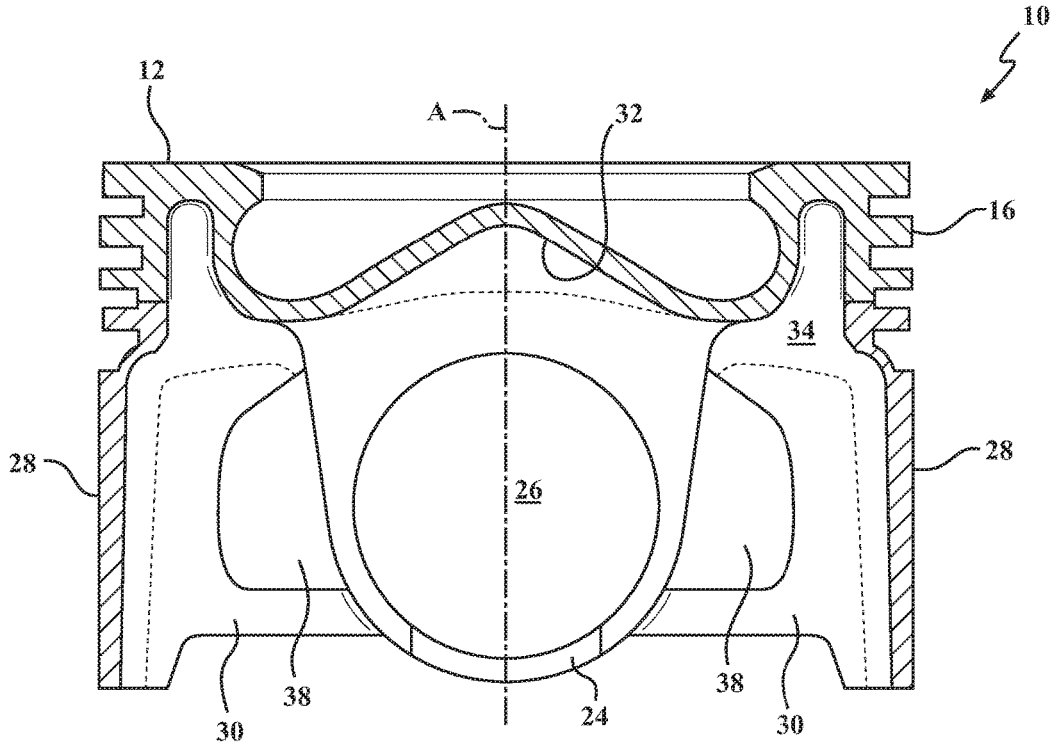
FIG. 7 is a cross-sectional view of a galleryless piston constructed in accordance with an example embodiment of the invention.

The holes 38 can comprise various different shapes and sizes. In the example embodiment, the holes 38 are cylindrical in shape and have a diameter ranging from 5 mm to 10 mm. However, the diameter of the holes 38 could be as small as 4 mm to as large as the design allows. FIG. 7 illustrates the piston 10 according to another example embodiment with larger holes 38 formed in the struts 30 adjacent the pin boss 24 to connect the inner undercrown region 34 and the outer pockets 36.

The holes 38 can be formed by various different methods. In one embodiment, the holes 38 are cast or forged into the monolithic body of the piston. In another embodiment, the holes 38 are drilled between the inner undercrown region 34 and the outer pockets 36 after the monolithic body is formed.

According to the embodiment of FIGS. 8-10, the piston 10 includes at least one deflector 44 disposed in the inner undercrown region 34 to divert the cooling oil. The deflector 44 can be located along an inner surface of one of the skirt panels 28 and/or along the undercrown surface 32. The deflector 44 can be designed to include one or more recesses 46 and/or one or more ribs 48. In the example embodiment, the deflector includes a rib-shaped elevation, for example at least one rib 48 disposed between a pair of the recesses 46, or more specifically, two ribs 48 disposed between a pair of the recesses 46. In addition, another recess 46 can be located along the undercrown surface 32 opposite the ribs 48. In the example embodiment shown in FIG. 10, the length of the single recess 46 located on the right side of the piston 10 is approximately equal to the length of the ribs 48 and recesses 46 on the left side of the piston 10. If the cooling oil is sprayed into the recesses 46, the oil can be collected and directed in the correct direction. According to one embodiment, each recess 46 is elongated and largely extends in the circumferential direction of the piston 10, in order to direct the cooling oil in the direction of the holes 38. Alternatively, or in addition, one of the recesses 46 can be largely radially extending between the two elevated ribs 48, as shown in FIG. 10, which act as cooling oil beam splitters, so that the cooling oil is directed to toward the center axis A between the pin bosses 24, at least to a certain extent. Also, the ribs 48 can act as a cooling oil beam splitter to divert a portion of the sprayed coolant in more than one direction. In the example embodiment of FIG. 10, the pair of ribs 48 is located at a central point between the pin bosses 24, along one of the skirt panels 28, and the ribs 48 extend parallel to the pin bosses 24 to direct the cooling oil toward the center axis A of the undercrown surface 32 between the pin bosses 24. In this embodiment, one recess 46 is located between the ribs 48 and two other recesses 46 are located on opposite sides of the ribs 48, adjacent the struts 30. More specifically, in this embodiment of FIG. 10, the deflector 44 directs the cooling oil through the left holes 38 and into one or both of the outer pockets 36 and also toward the center axis A of the piston 10 between the pin bosses 24. In this case, the cooling oil can be conveniently sprayed at an angle such that, when the piston 20 is at bottom dead center, cooling oil will be targeted at one recess 46. As the piston 20 rises from bottom dead center to top dead center, the targeting location of the cooling oil will shift across the piston 10 towards the second recess 46 opposite the two ribs 48. In the process, the beam of sprayed oil will traverse the two ribs 48 and display the effect outlined above. Finally, when the piston 10 reaches top dead center the cooling oil will be targeted at the recess 46 opposite the two ribs 48.

Alternatively, a recess 46 can be provided instead of the two ribs 48, or the recess 46 can be provided only between the two ribs 48. Each recess 46 preferably borders one of the struts 30 so that the recesses 46 can conveniently ensure that the cooling oil which accesses the recesses 46 will run in the direction of the at least one hole 38 in the pin boss 24 or strut 30 and therefore into the outer pocket 36. When using the at least one deflector 44, it is preferable to combine the piston 10 with a coolant nozzle (not shown) which sprays the cooling oil at an oblique angle in relation to the center axis A of the piston. With this, depending on the position of the piston 10, different areas of the piston 10 can be cooled along its stroke.

Another aspect of the invention provides a method of manufacturing the galleryless piston 10 for use in the internal combustion engine. The body portion of the piston 10, which is typically formed of steel or aluminum, can be manufactured according to various different methods, such as forging or casting. The body portion of the galleryless piston 10 can also comprise various different designs, an example of the design is shown in FIGS. 1-6.

The method further includes providing holes 38 in the piston 10 which extend from the inner undercrown region 34 to the outer pockets 36. This step can include casting the holes 38 during the process of casting or forging the monolithic body, or other suitable processing, such as drilling the holes 38 after providing the monolithic body. The holes 38 typically extend through the pin boss 24 and/or struts 30. The holes 38 can also extend through a small portion of the undercrown surface 32. The deflector 44 can also be formed during the casting or forging process, or through suitable processing.

Many modifications and variations of the present invention are possible in light of the above teachings and may be practiced otherwise than as specifically described while within the scope of the following claims. It is contemplated that all features of all claims and of all embodiments can be combined with each other, so long as such combinations would not contradict one another.

The invention claimed is:

1. A piston, comprising:

an upper wall including an undercrown surface exposed from an underside of said piston, a ring belt depending from said upper wall and extending circumferentially around a center axis of said piston, a pair of pin bosses depending from said upper wall, wherein each of said pin bosses presents a pin bore surrounding a pin bore axis, a pair of skirt panels depending from said ring belt and coupled to said pin bosses by struts, an inner undercrown region extending along said undercrown surface and surrounded by said skirt panels and said struts and said pin bosses, a pair of outer pockets extending along said undercrown surface, each outer pocket being surrounded by one of said pin bosses, a portion of said ring belt, and said struts coupling said one pin boss to said skirt panels, at least one hole extending through at least one of said pin bosses and/or at least one of said struts from said inner undercrown region to one of said outer pockets, and a deflector for directing cooling oil toward said center axis and/or toward said holes, said deflector including at least one rib disposed along an inner surface of one of said skirt panels and spaced from said pin bosses, and said at least one rib extending longitudinally between opposite ends and perpendicular to said pin bore axis.

2. The piston of claim 1, wherein said at least one hole includes two holes located between said inner undercrown region and a first one of said outer pockets, and said at least one hole includes two holes located between said inner undercrown region and a second one of said outer pockets.

3. The piston of claim 1, wherein each hole extends from a first opening to a second opening, said first opening is located in said inner undercrown region adjacent one of said struts between said skirt panel and pin boss, and said second opening is located in said outer pocket at a side of said pin boss adjacent said strut.

4. The piston of claim 1, wherein said holes are located adjacent said undercrown surface.

5. The piston of claim 1, wherein said holes are not parallel to said pin bore axis.

6. The piston of claim 1 including four of said holes, wherein two of said holes are located in each pin boss on opposite sides of said pin bore, and said holes border said ring belt.

7. The piston of claim 1, wherein said holes are cylindrical in shape and have a diameter of at least 4 mm.

8. The piston of claim 1, wherein said holes have a diameter ranging from 5 mm to 10 mm.

9. The piston of claim 1, wherein said at least one rib includes two ribs.

10. The piston of claim 1, wherein said piston includes a body formed of a single piece of material, said body includes said upper wall, said ring belt, said pin bosses, and said skirt panels.

11. The piston of claim 10, wherein said material of said body is steel or aluminum.

12. The piston of claim 1, wherein said piston does not include a cooling gallery floor or other feature bounding or partially bounding a cooling gallery.

13. The piston of claim 1 including a body formed of a single piece of material, said material of said body is steel or aluminum-based, said body does not have a cooling gallery floor or other features bounding or partially bounding a cooling gallery, said body includes said upper wall presenting an upper combustion surface, said upper combustion surface is a non-planar surface around said center axis, said ring belt includes a top land and a plurality of ring grooves extending circumferentially around said center axis and along an outer diameter of said piston, said pin bosses are disposed inwardly of said ring belt and provide said pin bores which are laterally spaced and surround said pin bore axis, said pair of skirt panels are located diametrically opposite one another, said undercrown surface is disposed radially inwardly of said ring belt, said undercrown surface is not bounded by an enclosed or partially enclosed cooling gallery or any other feature tending to retain fluid, a first portion of said undercrown surface is provided by said inner undercrown region and a second portion of said undercrown surface is provided by said outer pockets, said inner undercrown region is located at said center axis and is surrounded by said pin bosses and said skirt panels and said struts, said undercrown surface located in said inner undercrown region is concave when viewed from the bottom of said piston, said outer pockets are located outwardly of said pin bosses, a plurality of said holes extend through said pin bosses and/or said struts from said inner undercrown region to said outer pockets, said holes are located adjacent said undercrown surface, each hole extends from a first opening to a second opening, said first opening is located in said inner undercrown region and said second opening is located in an adjacent one of said outer pockets, said holes are not parallel to said pin bore axis, and said holes are cylindrical in shape and have a diameter ranging from 5 mm to 10 mm.

14. The piston of claim 13, wherein said at least one rib is disposed in said inner undercrown region along said inner surface of one of said skirt panels and along said undercrown surface, said at least one rib being disposed between a pair of recesses, and each recess on opposite sides of said at least one rib being elongated and extending in a circumferential direction.

15. A method of manufacturing a piston, comprising the steps of:

providing a body including an upper wall, the upper wall including an undercrown surface exposed from an underside of the piston, a ring belt depending from the upper wall and extending circumferentially around a center axis of the piston, a pair of pin bosses depending from the upper wall, each of said pin bosses presenting a pin bore surrounding a pin bore axis, a pair of skirt panels depending from the ring belt and coupled to the pin bosses by struts, an inner undercrown region extending along the undercrown surface and surrounded by the skirt panels and the struts and the pin bosses, a pair of outer pockets extending along the undercrown surface, each outer pocket being surrounded by one of the pin bosses and a portion of the ring belt and the struts coupling the one pin boss to the skirt panels, and a deflector for directing cooling oil toward the center axis and/or toward the holes, the deflector including at least one rib disposed along an inner surface of one of the skirt panels and spaced from the pin bosses, and the at least one rib extending longitudinally between opposite ends and perpendicular to the pin bore axis; and forming at least one hole through at least one of the pin bosses and/or at least one of the struts from the inner undercrown region to one of the outer pockets.

16. The method of claim 15, wherein the step of forming the at least one hole includes drilling the at least one hole through at least one of the pin bosses and/or at least one of the struts from the inner undercrown region to one of the outer pockets.

17. The method of claim 15, wherein said at least one rib includes two ribs.

18. The method of claim 15, wherein the body is a single piece of material, and the step of providing the body includes forging or casting the body.

19. The method of claim 18, wherein the holes are formed during the forging or casting step.

20. The method of claim 15, wherein the step of forming the at least one hole includes forming two of the holes between the inner undercrown region and a first one of the outer pockets, and forming two of the holes between the inner undercrown region and a second one of the outer pockets.

* * * * *